US008323054B2

(12) United States Patent
Igarashi et al.

(10) Patent No.: US 8,323,054 B2
(45) Date of Patent: Dec. 4, 2012

(54) COAXIAL CONNECTOR

(75) Inventors: Satoshi Igarashi, Tokyo (JP); Toshiya Matsudo, Tokyo (JP)

(73) Assignee: GV Technologies Corporation, Tokyo (JP)

( * ) Notice: Subject to any disclaimer, the term of this patent is extended or adjusted under 35 U.S.C. 154(b) by 0 days.

(21) Appl. No.: 13/074,321

(22) Filed: Mar. 29, 2011

(65) Prior Publication Data

US 2011/0256760 A1 Oct. 20, 2011

(30) Foreign Application Priority Data

Apr. 19, 2010 (JP) ..... 2010-096067

(51) Int. Cl.
*H01R 9/05* (2006.01)

(52) U.S. Cl. ..... 439/578

(58) Field of Classification Search ..... 439/578–585
See application file for complete search history.

(56) References Cited

U.S. PATENT DOCUMENTS 6,827,608 B2 * 12/2004 Hall et al. ..... 439/578

* cited by examiner

*Primary Examiner* — Ross Gushi
(74) *Attorney, Agent, or Firm* — Dilworth & Barrese, LLP.

(57) ABSTRACT

Provided is a technique to connect connectors that electrically connect coaxial cables to each other, the technique capable of reducing errors in manual work and improving work efficiency by making the work easier and simpler. Plural slots 123 each extending in an axial direction are provided in a base-end-side supporting region α of an outer conductor 12 of a contact-section portion 14. Base-end-side supporting pieces 124 deformable radially are formed by the slots. The base-end-side supporting region of the contact-section portion is attached to the inside of a supporting tubular portion 171 of a housing 17, and thereby a leading-end-side un-supported region β that is not supported by the housing is allowed to incline with respect to the axial direction.

18 Claims, 12 Drawing Sheets

COAXIAL CONNECTOR

BACKGROUND OF THE INVENTION

1. Field of the Invention

The invention relates to a cable connector to electrically connect cables to each other, and specifically to a coaxial connector with a structure capable of electrically connecting coaxial cables to each other without requiring any manual work when a connection system for transmitting radio-frequency power is built.

2. Description of the Related Art

In recent years, a growing number of processes of manufacturing electrical apparatuses have used radio-frequency power. In addition, there is a tendency that the frequency and magnitude of the power used for this purpose have become higher and higher. Transmission of radio-frequency power in such manufacturing processes needs transmission lines with the above-described coaxial structure to take advantage of the efficiency of the radio-frequency power transmission. Transmission lines of coaxial structure are connected to each other with special cable connectors called coaxial connectors. Coaxial connectors allow electrical connection between such coaxial cables, or between the coaxial cable to an electrical apparatus or a measurement instrument.

Meanwhile, a coaxial cable includes: a center conductor used for transmitting, for example, radio-frequency (RF) power or RF signals; an insulator layer (dielectric) provided around the center conductor; an outer conductor provided around the insulator; and a protective layer coating the outer conductor. Such coaxial cable has a rated characteristic impedance (e.g., 50Ω or 75Ω) for electric signal transmission.

Various fixing means have been proposed as methods allowing electrical connection between such coaxial cables by use of a coaxial connector. Some of the currently proposed means are screw-in fixing means, and such fixing means capable of one-touch connection as ball-locking mechanisms and bayonet-sleeve mechanisms (see, for example, Japanese Patent Application Publication No. 2006-147272, Japanese Utility Model Registration Application No. 2009-123591, U.S. Pat. No. 5,928,021).

However, the connection with connectors by those means described in Patent Literatures 1 to 3 require manual work, and hence is not preferable in view of safety, reliability, time-saving, and the like in the manufacturing processes. The connection/disconnection means that require manual work need complicated work and management under various specific fastening requirements. Consequently, the work efficiency may be impaired and human errors may be provoked. In particular, a change in impedance that occurs in the connection of coaxial cables with rated characteristic impedances may cause abnormal operations or malfunctions, and therefore transmission of power or signals needs matching of impedances at the connecting portion.

In addition, if conventional connectors are connected automatically with their center axes misaligned, such misalignment cannot be properly handled (cannot be corrected), and may thus cause breakage of the connectors or loose connection. If connectors are manually connected, misalignment of the center axes of the conductor portions of the connected connectors can be appropriately corrected on the spot. By contrast, if connectors are automatically connected, the connectors move linearly so that misalignment of the center axes of the conductor portions of the connected connectors results in such burdens as friction, loads, and stresses exerted on the conductor portions, and thus makes the connection more difficult. If such misaligned connectors are forcedly connected by use of a strong physical force, the connectors may be broken. Above all, the very existence of a mechanism that requires manual work prevents the connectors from being connected/disconnected automatically.

In recent years, manufacturing of semiconductors, flat-panel displays, and the like has required RF high power. Connectors that support the transmission of such high power as one exceeding 1 kw are currently connected to each other still by manual work because the need for the automatization of such connecting work has been scarcely felt.

Therefore, what is now demanded is a proposal for a coaxial connector including connectors easily connectable in a totally automated manner without requiring any manual work along with the electrical connection of coaxial cables supporting transmission of RF high power.

SUMMARY OF THE INVENTION

The invention has been made in view of the circumstances described above, and an object thereof is to provide a technique to connect connectors that electrically connect coaxial cables, in particular coaxial cables for RF high power, the technique being capable of reducing errors associated with manual work and improving work efficiency by making the work easier and simpler.

Another object of the invention is to provide a technique capable of easily checking the connecting state of the connectors in the case of employing the above-mentioned connection technique.

A coaxial connector according to the present invention is a coaxial connector including, as a pair of male and female connectors, a first connector and a second connector each including a contact portion that includes: a rod-shaped center conductor; and a tubular outer conductor that surrounds a circumference of the center conductor almost entirely in a lengthwise direction thereof, the contact portions of the connectors electrically connected to or disconnected from each other by being fitted to or removed from each other only by an operation of sliding the connectors along an axis of a line on which the connectors are arranged. The contact portion of at least one of the connectors includes a contact-section portion in which the center conductor, the outer conductor and an insulator are formed with no gap disposed therebetween while the center conductor and the outer conductor are disposed across the insulator to be away from each other at a predetermined distance, the contact-section portion being attached to a housing included in the connector. Plural slots each extending in an axial direction are provided on a base-end portion side of the outer conductor in the contact-section portion, the base-end portion side being a side to be attached to the housing. The plural slots form base-end-side supporting pieces allowing deformation in a radial direction.

A coaxial connector according to the present invention is the coaxial connector in which the contact-section portion is attached to the housing with a spacer disposed in between.

A coaxial connector according to the present invention is the coaxial connector in which the spacer is an elastic supporting member that produces a restoring force upon deformation.

A coaxial connector according to the present invention is the coaxial connector in which the elastic supporting member is made of an insulating polymer material.

A coaxial connector according to the present invention is the coaxial connector in which the elastic supporting member is a ring-shaped body.

A coaxial connector according to the present invention is the coaxial connector in which plural slots each extending in the axial direction are provided on a leading-end portion side of the outer conductor of the contact-section portion, the leading-end portion side being a side not attached to the housing, the slots form leading-end-side supporting pieces that allow deformation in the radial direction.

A coaxial connector according to the present invention is the coaxial connector in which each of the base-end-side supporting pieces in the contact-section portion has a tapered shape with a thickness decreasing towards a base-end side thereof.

A coaxial connector according to the present invention is the coaxial connector in which each of the leading-end-side supporting pieces in the contact-section portion has a tapered shape with a thickness decreasing towards a leading-end side thereof.

A coaxial connector according to the present invention is the coaxial connector in which the housing includes: a pitted accommodating portion in which the contact-section portion is accommodated with a gap in between; and a supporting tubular portion that is formed contiguously to the pitted accommodating portion, has an aperture with a smaller diameter than an internal diameter of the pitted accommodating portion, and allows the base-end portion side of the outer conductor in the contact-section portion to be inserted into the supporting tubular portion. The base-end portion side of the outer conductor of the contact-section portion is attached to the housing by a pressure-contact force exerted on the supporting tubular portion by the base-end-side supporting pieces.

A coaxial connector according to the present invention is the coaxial connector in which the housing includes a substantially tubular receptor portion including a small-diameter portion with a smaller diameter than an external diameter of the contact-section portion.

A coaxial connector according to the present invention is the coaxial connector in which the receptor portion includes a tapered surface with a thickness decreasing towards a leading-end side thereof.

A coaxial connector according to the present invention is the coaxial connector in which the receptor portion is detachably attached to the housing.

A coaxial connector according to the present invention is the coaxial connector in which any one of the connectors has a mark provided on an external surface of the outer conductor in the contact portion, the mark allowing a determination on whether or not the one of the connectors is connected to the other connector appropriately.

A coaxial connector according to the present invention is the coaxial connector in which the mark is in a different color from a color of the outer conductor, and is provided in a region covered by the other connector when the one and the other connectors are fitted together.

A coaxial connector according to of the present invention is the coaxial connector in which any one of the connectors includes a sensor that generates electric signals which allow a determination on whether or not the one of the connectors is fitted to the other connector appropriately.

A coaxial connector according to the present invention is the coaxial connector in which the first connector is a plug unit including a male center conductor with a protruding leading end. The second connector is a receptacle unit including a female center conductor with a pitted leading end. The center conductor of the second connector includes a pitted receptor portion located in a leading-end portion thereof and allowing the center conductor of the first connector to be inserted into the pitted receptor portion. The pitted receptor portion includes a small-diameter narrowed supporting region formed with closed-end slots extending in the axial direction, and is capable of elastically coming into pressure contact with a circumference of the leading end of the center conductor of the first connector.

A coaxial connector according to the present invention is the coaxial connector in which the first connector is a receptacle unit including a female center conductor with a pitted leading end. The second connector is a plug unit including a male center conductor with a protruding leading end. The center conductor of the first connector includes a pitted receptor portion located in a leading-end portion thereof and allowing the center conductor of the second connector to be inserted into the pitted receptor portion. The pitted receptor portion includes a small-diameter narrowed supporting region formed with closed-end slots extending in the axial direction, and is capable of elastically coming into pressure contact with a circumference of the leading end of the center conductor of the second connector.

In the coaxial connectors of the invention, the contact portion of at least one of the connectors includes the contact-section portion in which the center conductor, the outer conductor and the insulator are formed with no gap disposed therebetween while the center conductor and the outer conductor are disposed across the insulator to be away from each other at a predetermined distance. The contact-section portion is attached to the housing included in the connector. The plural slots each extending in the axial direction are provided on the base-end portion side of the outer conductor in the contact-section portion. The base-end portion side is a side that is to be attached to the housing. The plural slots form the plural base-end-side supporting pieces allowing deformation in a radial direction. The base-end-side supporting pieces allow the leading-end-side region of the contact-section portion that is not attached to the housing (i.e., not supported by the housing) to incline with respect to the axial direction.

Accordingly, even if one of the first connector and the second connector slides obliquely when the connectors automatically coupled together with no manual work, the center conductor and the outer conductor included in the leading-end-side region of the contact-section portion incline with respect to the axial direction to absorb the misalignment of the obliquely sliding connector, and thereby positional adjustment is made. Hence the first and the second connectors can be automatically fitted together smoothly without any such burdens as friction, loads, and stresses exerted on their respective conductor portions so as to allow the two connectors to be electrically connected to or disconnected from each other.

Accordingly, the invention can provide a coaxial connector which electrically connects coaxial cables to each other and which has a connector connecting technique capable of reducing errors in manual work and improving work efficiency by making the work easier and simpler.

DETAILED DESCRIPTION OF THE INVENTION

Figure 1:
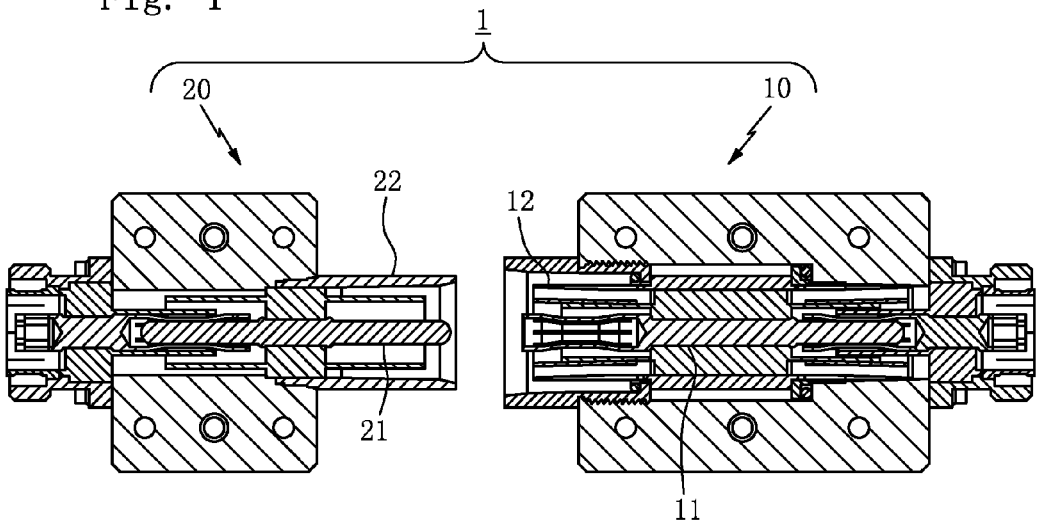
FIG. 1 is a sectional view showing the configuration of a coaxial connector of the invention.

Some exemplary embodiments of the invention are described below by referring to the drawings.

The coaxial connector of the invention includes a pair of male and female connectors, which are referred to as a first connector and a second connector. To electrically connect or disconnect the two connectors (first and second connectors), the coaxial connector needs only sliding of the two connectors along the axis defined by the linear arrangement of the two connectors because such sliding motion allows the contact portions of these two connectors to be fitted together or separated away from each other.

In this embodiment, to facilitate the understanding of the invention, description will be given by using a case where the first connector is a receptacle unit including a female center conductor with a pitted leading end, and the second connector is a plug unit including a male center conductor with a protruding leading end.

The following embodiments are some preferred exemplary embodiments of the invention, and therefore include various technically restricting features. The scope of the invention, however, is not limited to these embodiments unless specially mentioned otherwise in the following description.

Embodiment 1

As FIG. 1 shows, a coaxial connector 1 of this embodiment includes a receptacle unit 10 equipped with a female contact portion and a plug unit 20 equipped with a male contact portion. Each contact portion includes a rod-shaped center conductor and a tubular outer conductor that surrounds the circumference of the center conductor almost entirely along the lengthwise direction of the center conductor. Each of the receptacle unit 10 and the plug unit 20 allows a coaxial cable to be connected to the base-end side thereof.

Figure 2:
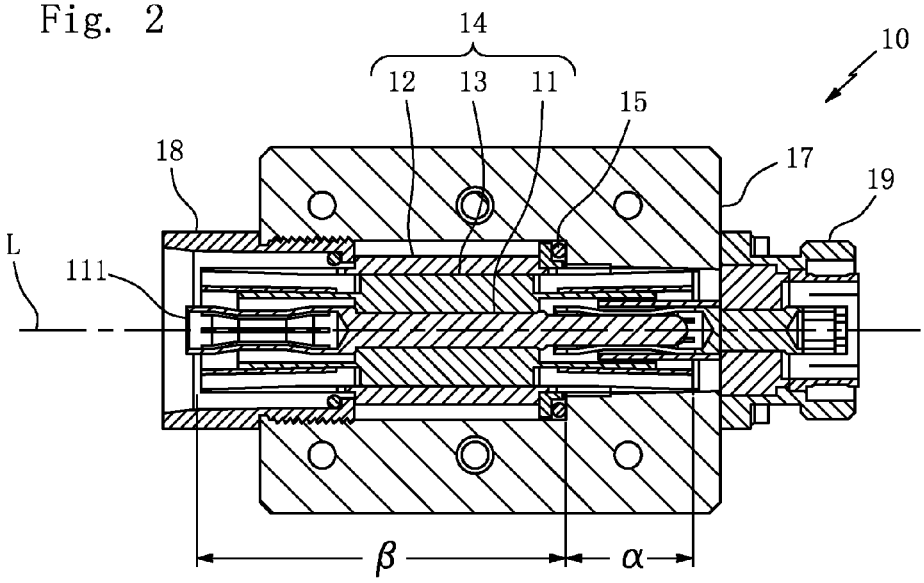
FIG. 2 is a sectional view showing a receptacle unit included in the coaxial connector of the invention.
Figure 3:
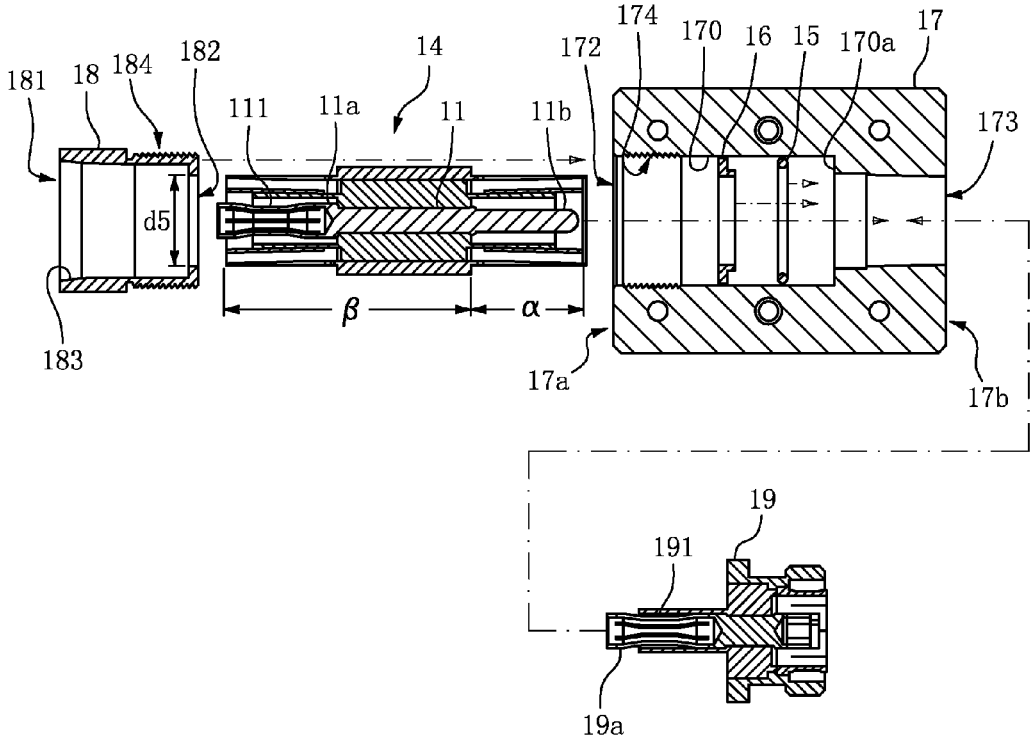
FIG. 3 is a developed sectional view describing the structure of the receptacle unit shown in FIG. 2.

As FIGS. 2 and 3 show, the receptacle unit 10 includes a contact-section portion 14, a housing 17, a plug receptor portion 18, and a coaxial-cable fixing connector portion 19.

The contact-section portion 14 includes a center conductor 11 and an outer conductor 12 that are to be electrically connected to the plug unit 20, and an insulator 13 provided between the center conductor 11 and the outer conductor 12. The conductors 11 and 12, and the insulator 13 are provided with no gaps therebetween.

That is, the center conductor 11 and the outer conductor 12 are supported as a single unit with the insulator 13 provided in between. In addition, the center conductor 11, the insulator 13, and the outer conductor 12 are coaxially arranged in equal proportions. Thus characteristic impedance (e.g., 50Ω or 75Ω) is defined for the transmission of radio-frequency (RF) power or RF signals.

The center conductor 11 is a rod-shaped conductor member and is to be electrically connected to the center conductor of the coaxial cable. The center conductor 11 is made, for example, of copper, a well-conducting metal with a similar conductivity to that of copper, a beryllium-copper alloy with high spring characteristics, or an alloy of spring characteristics that has similar functions. Specifically, phosphor bronze is preferable in view of the availability, cost, and the like reasons.

The center conductor 11 is thick enough to support high power.

Figure 4:
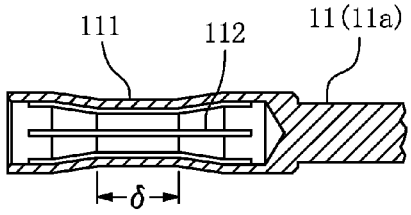
FIG. 4 is a partial enlarged view describing the structure of the leading-end portion of a center conductor of the receptacle unit shown in FIG. 2.

As FIG. 4 shows, the center conductor 11 includes a pitted receptor portion 111 on its leading-end portion 11*a* side. The pitted receptor portion 111 allows a predetermined region on a leading-end portion 21*a* side of a center conductor 21 of the plug unit 20 to be inserted thereinto. Details of the leading-end portion 21*a* are described later.

The pitted receptor portion 111 includes plural slots 112 each extending in the axial direction thereof, and a small-diameter narrowed supporting region δ formed by narrowing a region of the pitted receptor portion 111 radially inwards. The plural slots 112 are radially arranged in the circumference of the pitted receptor portion 111, and each of the slots 112 is a closed contact with its end portions closed (the end portions of each slot 112 are not open).

A predetermined region on a trailing-end portion 11*b* side of the center conductor 11 is electrically connected to a pitted receptor portion 191 (described later) of the coaxial-cable fixing connector portion 19. The coaxial-cable fixing connector portion 19 electrically connects the center conductor 11 to the coaxial cable.

The outer conductor 12 is a tubular conductor member surrounding the circumference of the center conductor 11 almost entirely in the lengthwise direction thereof, and is made, for example, of copper, a beryllium-copper alloy with high spring characteristics, or an alloy with spring characteristics having similar functions. Specifically, like the center conductor 11, the outer conductor 12 is made preferably of phosphor bronze in view of the availability, cost, and the like reasons. The outer conductor 12 has various functions such as a function as an electrostatic shield to prevent electrostatic induction, a function to maintain characteristic impedance, and a function to prevent the radio waves (signals) transmitted through the center conductor 11 from leaking out while preventing radio waves (signals) outside from entering the center conductor 11. In addition, the outer conductor 12 is to be electrically connected to the outer conductor of the coaxial cable via the housing 17.

Figure 5:
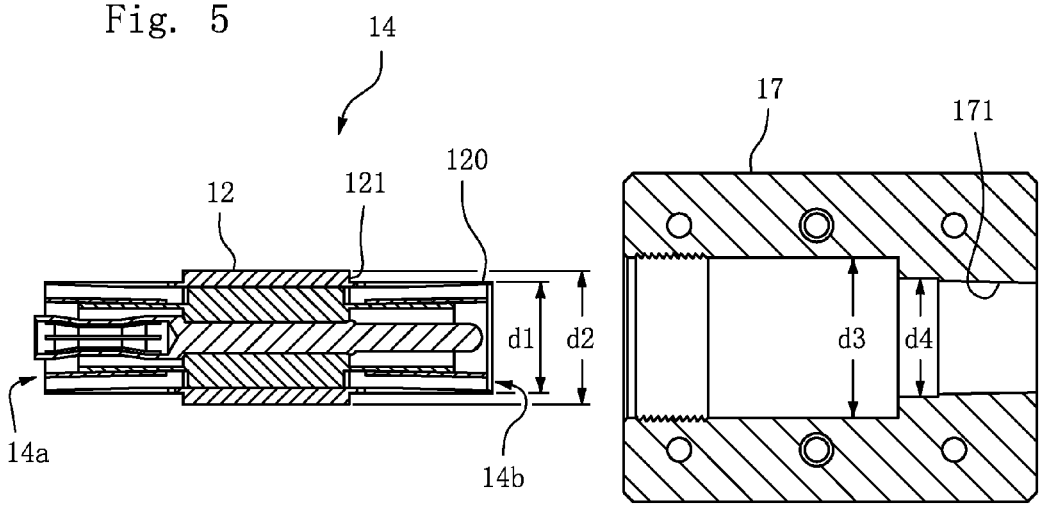
FIG. 5 is a developed sectional view describing the relationship between a contact-section portion and a housing employed in the receptacle unit shown in FIG. 2.

As FIG. 5 shows, the outer conductor 12 has a large-diameter portion 121—a part of the outer conductor 12 with a larger external diameter. In FIG. 5, the large-diameter portion 121 is illustrated as a central portion of the outer conductor 12 raised in a protruding shape. That is, the large-diameter portion 121 is a protruding large-diameter portion.

Thus, the large-diameter portion 121 provided near the center of the outer conductor 12 has an external diameter d2 that is larger than the external diameter d1 of an end portion 120 side of the outer conductor 12 (i.e., d1<d2).

Figure 6:
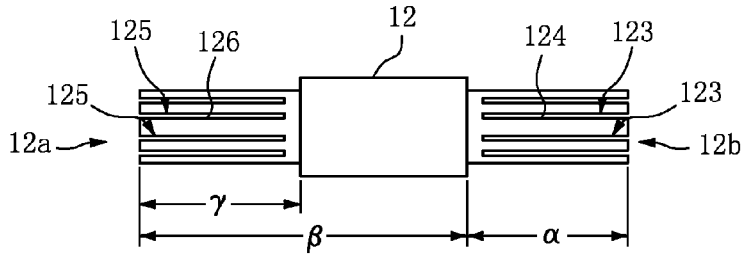
FIG. 6 is an overall view describing the structure of an outer conductor employed in the receptacle unit shown in FIG. 2.

As FIG. 6 shows, in the outer conductor 12, plural slots 123 each extending in the axial direction are provided in a region a near a base-end portion 12*b* thereof. The base end is supported by the housing 17 (accordingly, the region α is referred to as the "base-end-side supported region"). Each slot 123 has an end open towards the base-end portion 12*b*. In the outer conductor 12, base-end-side supporting pieces 124 are formed by the slots 123.

Figure 7:
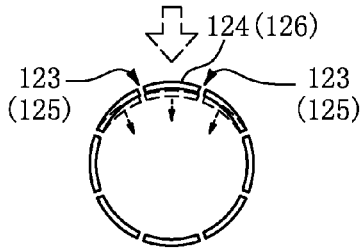
FIG. 7 is a partial enlarged view showing a principal portion and describing the structure of an end portion of the outer conductor shown in FIG. 6.

As FIG. 7 shows, the base-end-side supporting pieces 124 allow the outer conductor 12 to be deformed radially. FIG. 7 shows a state where a stress exerted from outside and indicated by the dotted arrow deforms the base-end-side supporting pieces 124 radially inwards as shown by the arrow-headed dotted lines.

As FIG. 6 shows, in the outer conductor 12, plural slots 125 each extending in the axial direction are provided in a leading-end-portion region γ, which is a part of a region β near a leading end 12*a* of the outer conductor 12. The leading end portion is not supported by the housing 17 (accordingly, the region γ is referred to as the "leading-end-side un-supported region"). Each slot 125 has an end open towards the base-end portion 12*a*. In the outer conductor 12, leading-end-side supporting pieces 126 are formed by the slots 125.

As FIG. 7 shows, the base-end-side supporting pieces 126 allow the outer conductor 12 to be deformed radially. FIG. 7 shows a state where a stress exerted from outside and indicated by the dotted arrow also deforms the leading-end-side supporting pieces 126 radially inwards as shown by the arrow-headed dotted lines.

The insulator 13 is an electrically insulating member provided between the center conductor 11 and the outer conductor 12 so as to prevent the center conductor 11 and the outer conductor 12 from being in contact with each other and to keep the center conductor 11 and the outer conductor 12 separated away from each other by a predetermined distance. The insulator 13 is made, for example, of a fluorine resin (polytetrafluoroethylene), which is a highly insulating material, or a polymer material with similar functions. The insulator 13 is disposed between the center conductor 11 and the outer conductor 12 so as to allow both a predetermined region located on the leading-end portion 11*a* side of the center conductor 11 and a predetermined region located on the base-end portion 11*b* side thereof to be exposed. The insulator 13 has a withstand voltage of 10 KVrms or higher, for example.

As FIGS. 3 and 5 shows, the housing 17 is a member including a pitted accommodating portion 170 and a supporting tubular portion 171. The housing 17 is made, for example, of brass or aluminum. The housing 17 is electrically connected to the outer conductor 12, and plays, though partially, a role of the grounding electrode for the outer conductor 12.

The pitted accommodating portion 170 is the portion where the contact-section portion 14 is accommodated with a gap in between. To put it differently, the pitted accommodating portion 170 surrounds the circumference of the leading-end-side un-supported region β of the outer conductor 12 with a predetermined clearance left in between. The pitted accommodating portion 170 has an internal diameter d3 that is larger than the external diameter d2 of the large-diameter portion 121 of the outer conductor 12 (i.e., d2<d3). Accordingly, the contact-section portion 14 can be inserted into the pitted accommodating portion 170 from a leading-end portion 17*a* side of the housing 17 through a leading-end opening portion 172.

The supporting tubular portion 171 is a portion that is formed contiguously to the pitted accommodating portion 170 and that allows the insertion of only the base-end-side region a of the contact-section portion 14. As FIG. 5 shows, the supporting tubular portion 171 has an aperture d4 that is smaller than the internal diameter d3 of the pitted accommodating portion 170 (i.e., d3>d4).

The aperture d4 of the supporting tubular portion 171 is substantially equal to the external diameter d1 of the end portion 120 side of the outer conductor 12 (i.e., d1≈d4). Thus, the housing 17 supports the contact-section portion 14 with the help of the pressure-contact force exerted by the base-end-side region a of the outer conductor 12 on the internal surface of the supporting tubular portion 171, and thereby supports the center conductor 11 that is unified with the outer conductor 12 by means of the insulator 13. Accordingly, the contact-section portion 14 can be taken out easily from both the supporting tubular portion 171 and the pitted accommodating portion 170.

In addition, the aperture d4 of the supporting tubular portion 171 is smaller than the external diameter d2 of the large-diameter portion 121 of the outer conductor 12. Accordingly, the large-diameter portion 121 is brought into contact with the shoulder of the opening portion of the supporting tubular portion 171 and gets stuck in that position to prevent the contact-section portion 14 from advancing (being pushed) into the housing 17 more than necessary, and to prevent the contact-section portion 14 from falling off from a base-end portion 17*b* side of the housing 17.

Note that the supporting tubular portion 171 has a base-end opening portion 173 located on the base-end portion 17*b* side of the housing 17. The base-end opening portion 173 allows a base-end portion 14*b* of the contact-section portion 14 that is inserted into the supporting tubular portion 171 to be exposed therefrom.

The plug receptor portion 18 is a substantially tubular member attached to the leading-end opening portion 172 of the housing 17, and is made, for example, of brass. The plug receptor portion 18 includes a fitting-side opening portion 181 that allows the leading-end portion 14*a* of the contact-section portion 14 to be exposed therefrom and a small-diameter portion 182 with an internal diameter d5 that is smaller than the external diameter d1 of the end portion 120 side of the contact-section portion 14. Accordingly, the plug receptor portion 18 uses the small-diameter portion 182 to prevent the contact-section portion 14 from falling off from the pitted accommodating portion 170 of the housing 17.

In addition, the plug receptor portion 18 is detachably attached to the housing 17. The attaching of the plug receptor portion 18 to the housing 17 is facilitated by, for example, providing a male thread groove in the external surface of the plug receptor portion 18 and a female thread groove in the internal surface of the housing 17.

In FIG. 3, the plug receptor portion 18 is illustrated as one provided with a male-thread-groove portion 184 in the external surface of the small-diameter portion 182 whereas the housing 17 is illustrated as one provided with a female thread groove 174 in the internal surface on the leading-end opening portion 172. Hence, the male-thread-groove portion 184 of the plug receptor portion 18 and the female thread groove 174 of the housing 17 are screwed to be detachably attached to each other.

Since being detachably attached to the housing 17, the plug receptor portion 18 can be replaced with various types of plug receptor portions 18 including the fitting-side opening portion 181 and the small-diameter portion 182 with different diameters and shapes.

In addition, by removing the plug receptor portion 18 from the housing 17, the contact-section portion 14 can be taken out of the pitted accommodating portion 170. Accordingly, the center conductor 11 can be replaced with various types of center conductors 11 with different shapes and structures.

In addition, the plug receptor portion 18 may preferably have a tapered surface 183 with a gradually decreasing thickness towards the fitting-side opening portion 181. When the plug receptor portion 18 is fitted to the plug unit 20, the tapered surface 183 functions as a guide to facilitate the fitting.

The coaxial-cable fixing connector portion 19 is a member for connecting the coaxial cable and is attached to the base-end opening portion 173 of the housing 17. In addition, the coaxial-cable fixing connector portion 19 includes a pitted receptor portion 191 located on its leading-end portion 19*a* side. The pitted receptor portion 191 accepts the insertion of the base-end portion 11*b* side of the center conductor 11 included in the contact-section portion 14, and thus enables an electrical connection. Accordingly, the coaxial-cable fixing connector portion 19 allows the coaxial cable to be attached to the housing 17.

The receptacle unit 10 is assembled in the following way. Firstly, the contact-section portion 14 is inserted into the pitted accommodating portion 170 of the housing 17 through the leading-end opening portion 172 of the housing 17. Then, the contact-section portion 14 is pressed further so that the base-end-side region α of the contact-section portion 14 can be inserted into the supporting tubular portion 171 of the housing 17. Then, after the contact-section portion 14 is inserted into the housing 17, the plug receptor portion 18 is attached to the leading-end opening portion 172 of the housing 17.

Subsequently, the coaxial-cable fixing connector portion 19 is attached to the base-end opening portion 173 of the housing 17 so that the base-end portion 11*b* side of the center conductor 11 in the contact-section portion 14 can be inserted into the pitted receptor portion 191. Thus, the receptacle unit 10 can be assembled easily.

In the receptacle unit 10 with the above-described structure, the base-end-side region a of the outer conductor 12 in the contact-section portion 14 is attached to and thus supported by the housing 17. In contrast, the leading-end-side un-supported region β of the outer conductor 12 of the contact-section portion 14 is not supported by the housing 17. Accordingly, the leading-end-side un-supported region β is allowed to incline with respect to the axial direction.

Figure 8A:
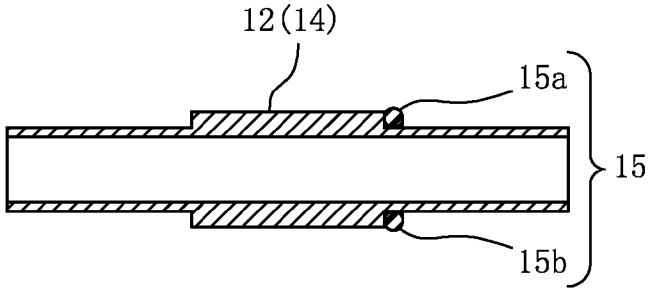
FIGS. 8A to 8C are diagrams schematically showing the movement of the contact-section portion (outer conductor) employed in the receptacle unit shown in FIG. 2.
Figure 8B:
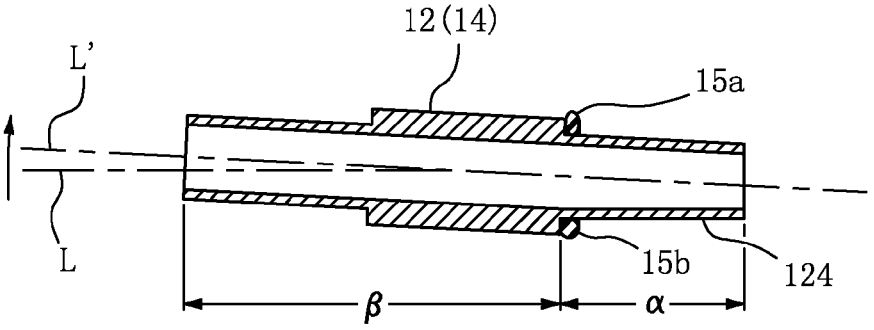
Figure 8C:
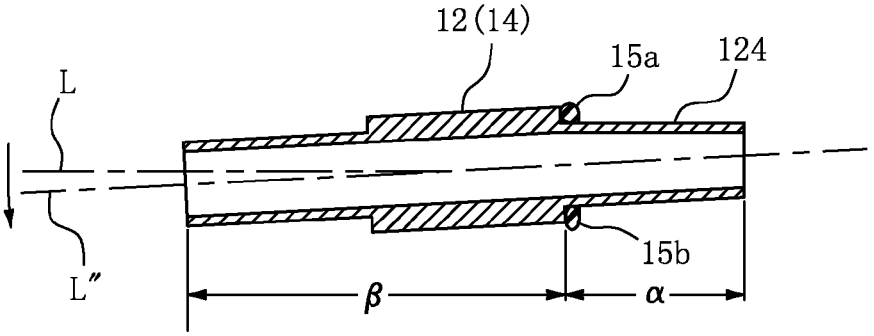

The inclining motion of the leading-end-side un-supported region β of the outer conductor 12 is schematically illustrated in FIGS. 8A to 8C.

FIG. 8A shows a state where the outer conductor 12 is attached to the housing 17. FIG. 8A shows that the outer conductor 12 is placed (inserted) straight.

FIG. 8B shows a state where a stress is exerted, from a certain direction, on the outer conductor 12 attached to the housing 17. Specifically, FIG. 8B shows a state where a stress is exerted on the outer conductor 12 in the direction indicated by the arrow, so that some of the base-end-side supporting pieces 124 are brought into contact with the internal surface of the supporting tubular portion 171 and are deformed radially inwards, and that the leading-end-side un-supported region β inclines, in a three-dimensional manner, from the axial direction L to a direction L'.

FIG. 8C shows a state where a stress is exerted, from the opposite direction, on the outer conductor 12 attached to the housing 17. Specifically, FIG. 8C shows a state where a stress is exerted on the outer conductor 12 in the direction indicated by the arrow, so that some of the base-end-side supporting pieces 124 are brought into contact with the internal surface of the supporting tubular portion 171 and are deformed radially inwards, and that the leading-end-side un-supported region β inclines, in a three-dimensional manner, from the axial direction L to a direction L".

Figure 9:
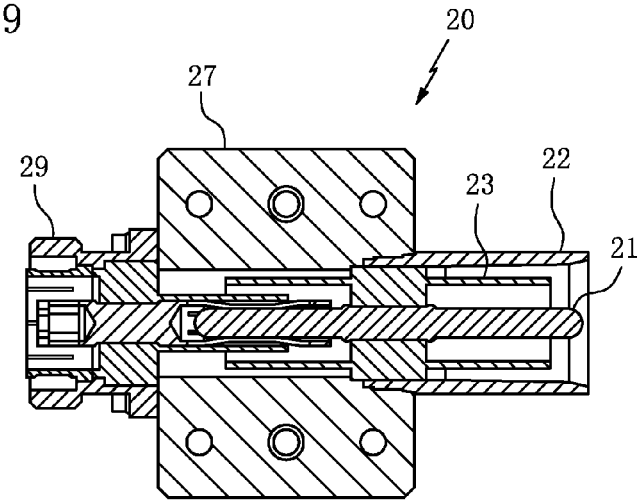
FIG. 9 is a sectional view showing a plug unit included in the coaxial connector of the invention.
Figure 10:
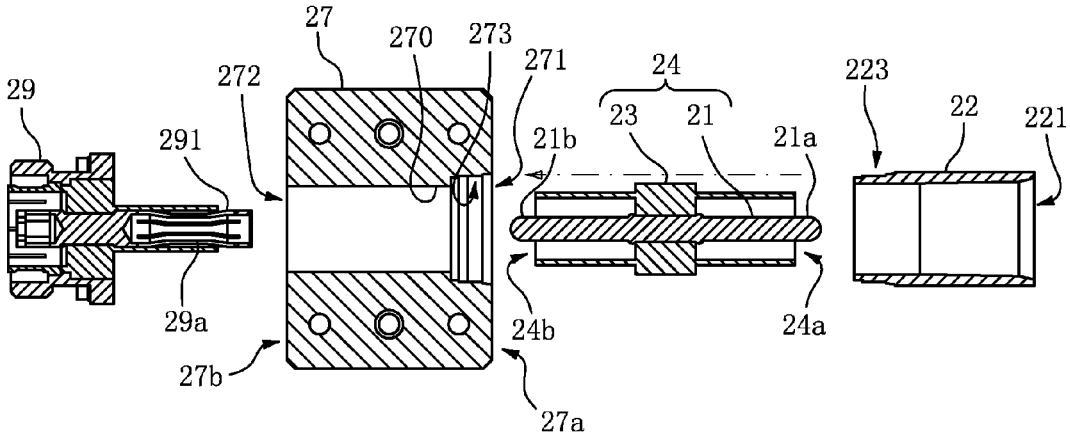
FIG. 10 is a developed sectional view describing the structure of the plug unit shown in FIG. 9.

Meanwhile, as FIGS. 9 and 10 show, the plug unit 20 includes a contact-section portion 24, a housing 27, an outer conductor 22, and a coaxial-cable fixing connector portion 29.

The contact-section portion 24 includes the aforementioned center conductor 21 that is to be electrically connected to the receptacle unit 10, and an insulator 23 supporting the center conductor 21. The center conductor 21 and the insulator 23 are provided with no gap therebetween.

The center conductor 21 is a rod-shaped conductor member that is to be electrically connected to the center conductor of a coaxial cable. The center conductor 21 is made, for example, of copper, a well-conducting metal with a similar conductivity to that of copper, a beryllium-copper alloy with high spring characteristics, or an alloy of spring characteristics that has similar functions. Specifically, phosphor bronze is preferable in view of the availability, cost, and the like reasons.

Figure 11A:
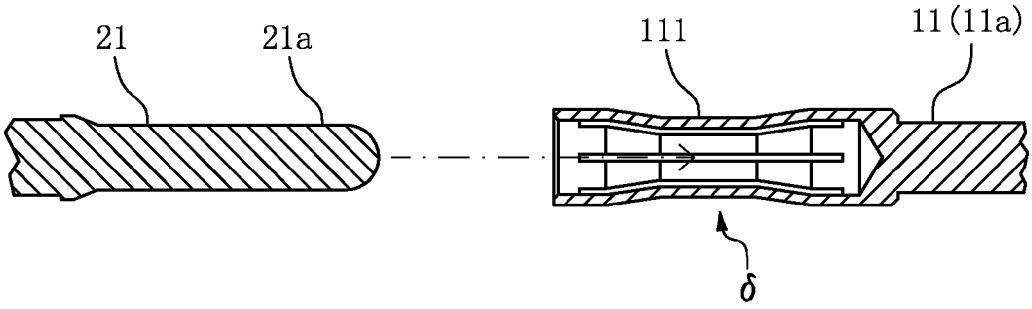
FIGS. 11A and 11B are partial enlarged views showing both the leading-end portion of a center conductor included in the receptacle unit and the leading-end portion of a center conductor included in the plug unit before and after the receptacle unit and the plug unit are fitted together.
Figure 11B:
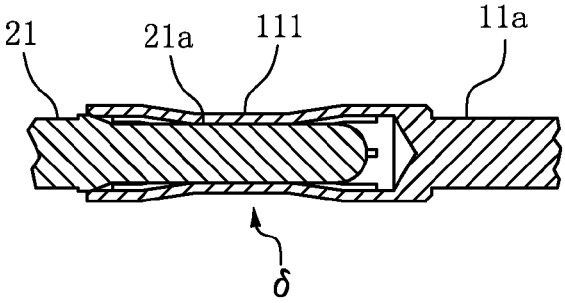

As FIG. 11A shows, a predetermined region on the leading-end portion 21*a* side of the center conductor 21 is inserted into the pitted receptor portion 111 located on the leading-end portion 11*a* side of the center conductor 11 of the receptacle unit 10. Then, as FIG. 11B shows, the leading-end portion 21*a* side of the center conductor 21 is elastically brought into pressure-contact with the small-diameter narrowed supporting region δ formed in the pitted receptor portion 111 while sufficient contact area can be secured uniformly.

As described above, the small-diameter narrowed supporting region δ of the pitted receptor portion 111 of the center conductor 11 of the receptacle unit 10 elastically comes into pressure-contact with and thus holds the circumference of a predetermined region on the leading-end portion 21*a* side of the center conductor 21 of the plug unit 20. Accordingly, a stable electrical connection can be achieved with a broader contact surface thus secured. In addition, the broader contact area can prevent the heat that would be generated by a narrower contact area between conductors electrically connected to each other.

A predetermined region on a trailing-end portion 21*b* side of the center conductor 21 is electrically connected to a pitted receptor portion 291 of the coaxial-cable fixing connector portion 29 (described later). The coaxial-cable fixing connector portion 29 electrically connects the center conductor 21 to the coaxial cable.

The outer conductor 22 is a substantially tubular conductor member attached to a leading-end opening portion 271 of the housing 27, and is made, for example, of copper, a beryllium-copper alloy with high spring characteristics, or an alloy with spring characteristics having similar functions. Specifically, the outer conductor 22 is made preferably of brass in view of the availability, cost and the like reasons. The outer conductor 22 is electrically connected to the outer conductor of the coaxial cable via the housing 27. In addition, the outer conductor 22 surrounds the circumference of the contact-section portion 24, and has a fitting-side opening portion 221 that allows the leading-end portion 24*a* side of the contact-section portion 24 to be exposed therefrom.

In addition, the outer conductor 22 is detachably attached to the housing 27. The attaching of the outer conductor 22 to the housing 27 is facilitated by, for example, providing a male thread groove in the external surface of the outer conductor 22 and a female thread groove in the internal surface of the housing 27.

In FIG. 10, the outer conductor 22 is illustrated as one provided with a male-thread-groove portion 223 in the external surface of a base-end portion 22*b* thereof whereas the housing 27 is illustrated as one provided with a female thread groove 273 in the internal surface on the leading-end opening portion 271. Hence, the male-thread-groove portion 223 of the outer conductor 22 and the female thread groove 273 of the housing 27 are screwed to be detachably attached to each other.

Since being detachably attached to the housing 27, the outer conductor 22 can be replaced with various types of outer conductors 22 including the fitting-side opening portion 221 with different diameters and shapes.

In addition, by removing the outer conductor 22 from the housing 27, the contact-section portion 24 can be taken out of an insertion tubular portion 270 of the housing 27. Accordingly, the center conductor 21 can be replaced with various types of center conductors 11 with different shapes and structures.

The insulator 23 is an insulating member allowing both a predetermined region located on the leading-end portion 21*a* side of the center conductor 21 and a predetermined region located on the base-end portion 21*b* side thereof to be exposed. In addition, the insulator 23 is formed into a tubular shape and disposed to surround the circumference of the exposed portion on the leading-end portion 21*a* side of the center conductor 21 and the exposed portion on the base-end portion 21*b* side thereof almost entirely in the lengthwise direction thereof. The insulator 23 is made, for example, of a fluorine resin (polytetrafluoroethylene).

The housing 27 includes the insertion tubular portion 270, the leading-end opening portion 271, and a base-end opening portion 272.

In addition, the housing 27 is electrically connected to the outer conductor 22, and plays, though partially, a role of the grounding electrode for the outer conductor 22.

The insertion tubular portion 270 allows a base-end portion 24*b* side of the contact-section portion 24 to be inserted thereinto. The leading-end opening portion 271 allows the contact-section portion 24 to be inserted into the insertion tubular portion 270 from a leading-end portion 27*a* side of the housing 27.

The base-end opening portion 272 allows the base-end portion 24*b* of the contact-section portion 24 inserted into the insertion tubular portion 270 is exposed from the base-end portion 27*b* side of the housing 27.

The coaxial-cable fixing connector portion 29 is a member for connecting the coaxial cable and is attached to the base-end opening portion 272 of the housing 27. In addition, the coaxial-cable fixing connector portion 29 includes the pitted receptor portion 291 located on its leading-end portion 29*a* side. The pitted receptor portion 291 accepts the insertion of the base-end portion 21*b* side of the center conductor 21 included in the contact-section portion 24, and thus enables an electrical connection. Accordingly, the coaxial-cable fixing connector portion 29 allows the coaxial cable to be attached to the housing 27.

The plug unit 20 is assembled in the following way. Firstly, a base-end-side region η of the contact-section portion 24 is inserted into the insertion tubular portion 270 of the housing 27 through the leading-end opening portion 271 of the housing 27. Then, the outer conductor 22 is attached to the leading-end opening portion 271 of the housing 27.

Thereafter, the coaxial-cable fixing connector portion 29 is attached to the base-end opening portion 272 of the housing 27 so that the base-end portion 21*b* side of the center conductor 21 in the contact-section portion 24 can be inserted into the pitted receptor portion 291 of the coaxial-cable fixing connector portion 29. Thus, the plug unit 20 can be assembled easily.

Figure 12:
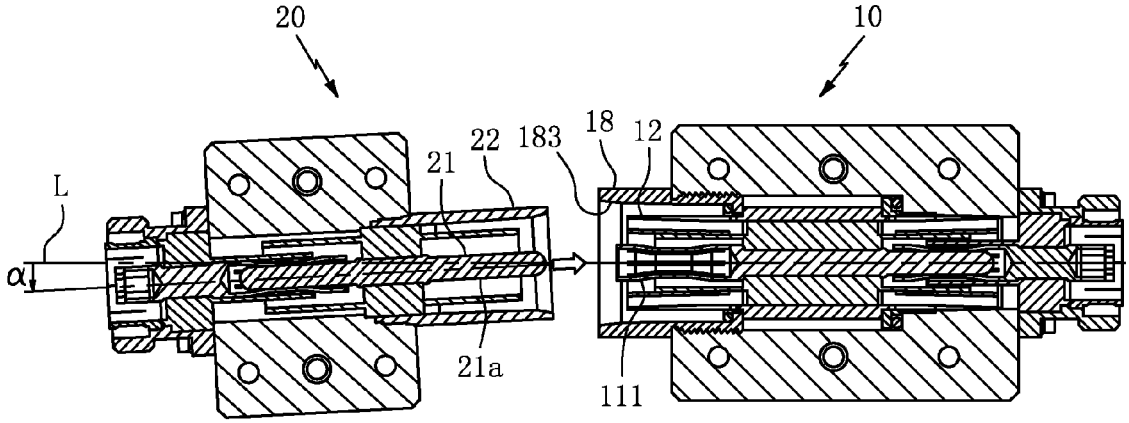
FIG. 12 is a sectional view showing the coaxial connector of the invention before the fitting.
Figure 13:
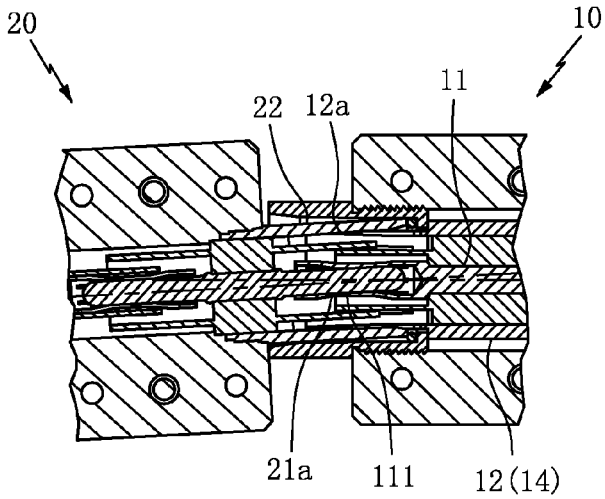
FIG. 13 is a sectional view showing the coaxial connector of the invention after the fitting.

As FIGS. 12 and 13 show, when the receptacle unit 10 and the plug unit 20 are coupled together, their contact angles and contact surfaces may be misaligned. However, even in such a case, the coaxial connector 1 with the above-described structure makes the plug receptor portion 18 of the receptacle unit 10 accept the insertion of the outer conductor 22 of the plug unit 20 while making the tapered surface 183 of the plug receptor portion 18 absorb the misalignment of the plug unit 20 side. Thus, the misalignment can be adjusted.

FIG. 12 shows a state where the plug unit 20 is coupled (fitted) to the receptacle unit 10 by sliding obliquely in a direction that is inclined from the axial direction L by an amount α as indicated by the arrow.

In FIG. 13, even if the plug unit 20 slides obliquely, the leading-end-side un-supported region β of the outer conductor 12 in the contact-section portion 14 of the receptacle unit 10 inclines three-dimensionally relative to the axial direction as described by referring to FIGS. 8A to 8C, and thus the center conductor 11 also inclines together with the leading-end-side un-supported region β of the outer conductor 12. In the meanwhile, the small-diameter narrowed supporting region δ formed in the pitted receptor portion 111 of the receptacle unit 10 absorbs the error caused by the misalignment of the center conductor 21 of the plug unit 20. Thus, the receptacle unit 10 performs adjustment of positions by absorbing the misalignment of the plug unit 20 side.

When the receptacle unit 10 and the plug unit 20 are coupled (fitted) to each other, the insertion of the outer conductor 22 of the plug unit 20 between the plug receptor portion 18 and the outer conductor 12 in the receptacle unit 10 makes the leading-end-side supporting pieces 126 formed on the leading-end portion 12*a* side of the outer conductor 12 in the receptacle unit 10 to be deformed radially to change the diameter of the leading-end-side supporting pieces 126. Then, the internal surface of the plug receptor portion 18 and the external surface of the outer conductor 12 (leading-end-side supporting pieces 126) in the receptacle unit 10 come into pressure-contact with and thus hold the outer conductor 22 of the plug unit 20. Accordingly, the contact portion of the receptacle unit 10 and that of the plug unit 20 can be easily fitted together in a pressure-contact manner, and the receptacle unit 10 can hold the plug unit 20 securely while the fitted state can be kept stably.

As has been described thus far, the invention allows the receptacle unit 10 and the plug unit 20 to be automatically fitted together smoothly without any such loads as friction and stress exerted on the contact portions of the receptacle unit 10 and of the plug unit 20, and thus allows the receptacle unit 10 and the plug unit 20 to be electrically connected to or disconnected from each other.

Embodiment 2

The invention is capable of making the contact-section portion 14 incline in a more flexible manner.

Specifically, as FIGS. 2 and 3 show, this embodiment differs from Embodiment 1 in that a spacer 15 is disposed between the large-diameter portion 121 of the outer conductor 12 in the contact-section portion 14 and a floor portion 170*a* of the pitted accommodating portion 170 included in the housing 17.

Note that in each of the other embodiments that follow, the description focuses on those portions that are different from the case of Embodiment 1. Thus, constituent portions similar to those in Embodiment 1 are denoted by the same reference numerals, and the description of such portions will not be given. Those portions with the same reference numerals across various embodiments are identical to each other unless noted otherwise.

The spacer 15 creates a predetermined distance (gap) between the large-diameter portion 121 of the outer conductor 12 in the contact-section portion 14 and the floor portion 170*a* of the pitted accommodating portion 170 included in the housing 17. The gap prevents the large-diameter portion 121 from being brought into direct contact with the floor portion 170*a* in the pitted accommodating portion 170 of the housing 17 when the contact-section portion 14 inclines. Each of FIGS. 2 and 3 illustrates a state where the spacer 15 is attached to the position with a washer 16.

By disposing the spacer 15 between the large-diameter portion 121 of the outer conductor 12 in the contact-section portion 14 and the floor portion 170*a* of the pitted accommodating portion 170 included in the housing 17, the contact-section portion 14 can have a wider range of motion, and thus can incline more easily.

In addition, it is preferable that the spacer 15 be an elastic supporting member that exerts a restoring force upon deformation. If the spacer 15 is an elastic supporting member, its deformation restoring force helps the contact-section portion 14 (outer conductor 12) that inclines in a three-dimensional manner to easily restore the original position.

The spacer 15 may be a metal spring member. A metallic member, however, may produce fine metal debris if the inclining motion of the contact-section portion 14 makes the spacer 15 friction the internal surface (e.g., floor portion 170*a*) of the pitted accommodating portion 170 of the housing 17. Such fine metal debris may cause abnormal operations or malfunctions, and are, therefore, not desirable. Accordingly, it is preferable that the spacer 15 is made of an insulating polymer material, such for example as silicone rubber that can be prepared easily with small cost.

Figure 14:
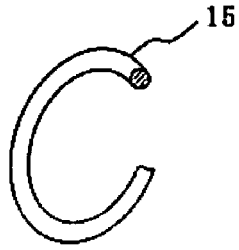
FIG. 14 is a partially-broken perspective view showing a spacer used in the receptacle unit.

In addition, as FIG. 14 shows, it is preferable that the spacer 15 be a ring-shaped member. The ring-shaped member may be one originally formed as a single unit. Alternatively, the ring-shaped member may include plural small bodies arranged continuously or at certain intervals (around the outer conductor 12) into a ring shape.

The ring-shaped spacer 15 can be easily installed around the outer conductor 12. In addition, the ring-shaped spacer 15 may be one that allows the contact-section portion 14 to incline freely in any direction of 360 degrees around the axial direction.

Accordingly, it is preferable that the spacer 15 of the invention be a ring-shaped body made of an insulating polymer material such as silicone rubber.

Embodiment 3

The invention is capable of making the contact-section portion 14 incline in an even more flexible manner.

Figure 15:
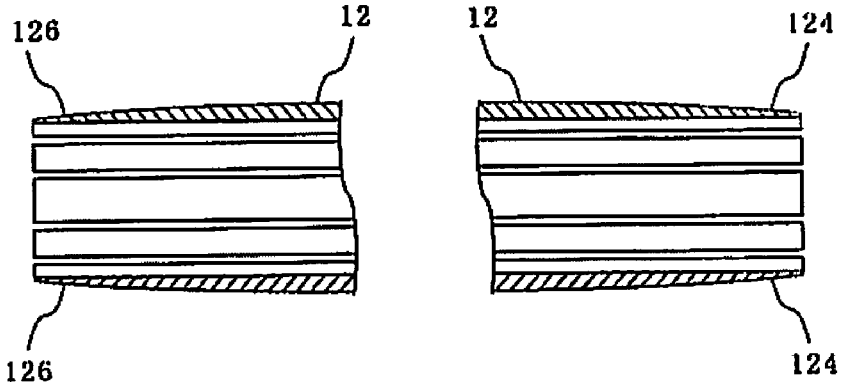
FIG. 15 is a partial enlarged view of a principal portion describing a different structure of the end portion of the outer conductor used in the receptacle unit.

Specifically, as FIG. 15 shows, this embodiment differs from each of the above-described embodiments in that the base-end-side supporting pieces 124 of the outer conductor 12 in the contact-section portion 14 are each formed into a tapered shape with a thickness decreasing towards the base end portion 12*b*.

Since the base-end-side supporting pieces 124 of the outer conductor 12 in the contact-section portion 14 are each formed in a tapered shape, the base-end-side supporting pieces 124 can incline radially in a more flexible manner, and the leading-end-side un-supported region β of the outer conductor 12 in the contact-section portion 14 can incline more easily.

Embodiment 4

The invention is capable of making the coupling (fitting) of the receptacle unit 10 and the plug unit 20 in an even more flexible manner.

Specifically, as FIG. 15 shows, this embodiment differs from each of the above-described embodiments in that the leading-end-side supporting pieces 126 of the outer conductor 12 in the contact-section portion 14 are each formed into a tapered shape with a thickness decreasing towards the leading end portion 12*a*.

Since the base-end-side supporting pieces 124 of the outer conductor 12 in the contact-section portion 14 are each formed in a tapered shape, the base-end-side supporting pieces 124 can incline radially in a more flexible manner, and the leading-end-side un-supported region β of the outer conductor 12 in the contact-section portion 14 can incline more easily.

Embodiment 5

As described earlier, the invention allows the receptacle unit 10 and the plug unit 20 to be automatically coupled (fitted) to each other by linear sliding motion with no manual work. Hence, it is necessary to securely check whether the coupling state is appropriate or not, before the subsequent process (operation) is performed. Accordingly, concerning the coupling of the receptacle unit 10 and the plug unit 20 to be automatically performed with no manual work, the invention allows the checking of the coupling state to be done easily.

As FIGS. 16A and 16B and FIGS. 17A and 17B show, this embodiment differs from each of the above-described embodiments in that the receptacle unit 10 or the plug unit 20 is equipped with a sensor that can determine whether the fitting state of the two units 10 and 20 is appropriate or not.

Figure 16A:
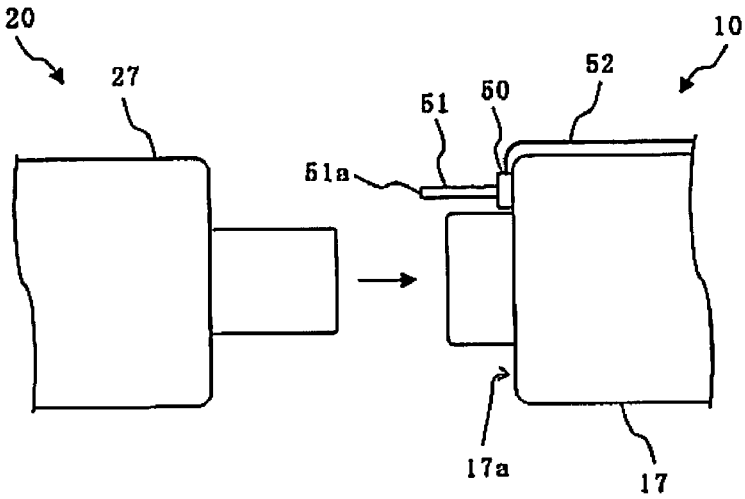
FIGS. 16A and 16B are schematic views showing the states before and after the fitting state of the coaxial connector of the invention is checked using first means.

FIG. 16A shows that the receptacle unit 10 includes a sensor 50 at the leading-end portion 17*a* of the housing 17. The sensor 50 includes a lever 51 configured to sense a contact pressure. If, for example, a leading-end portion 51*a* of the lever 51 is brought into contact with the housing 27 of the plug unit 20 and senses a contact pressure, the sensor 50 generates electric signals. The electric signals generated by the sensor 50 are taken out via a wire 52, then recognized by a control circuit (not illustrated), and thereafter used for the function to instruct the transition to the subsequent process (operation) that permits RF high power to flow through the coaxial connector 1. Some examples of the subsequent process (operation) are processes of testing or of manufacturing semiconductors, flat panel displays or the like performed by causing the RF high power to flow through the coaxial connector 1.

The electric signals generated by the sensor 50 are recognized by the control circuit. In addition, such electric signals may be used for other unillustrated purposes. For example, the electric signals may be used for generating sounds such as buzzer sounds, or for making a lighting device or the like emit light so that whether the receptacle unit 10 and the plug unit 20 are fitted together appropriately or not can be determined aurally or visually.

Figure 16B:
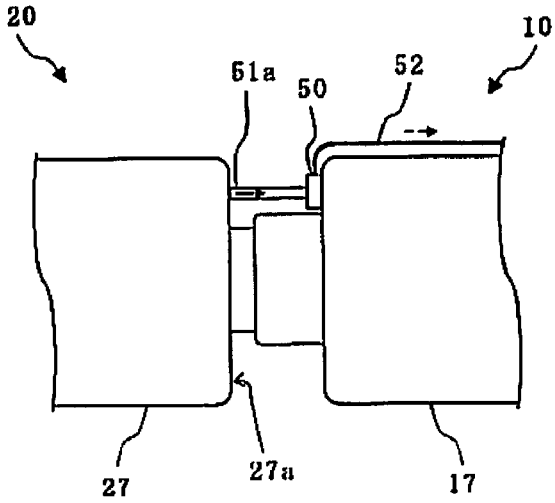

FIG. 16B shows that when the leading-end portion 51*a* of the lever 51 included in the sensor 50 is brought into contact with the leading-end portion 27*a* of the housing 27 of the plug unit 20 and senses a contact pressure, the sensor 50 generates electric signals.

Figure 17A:
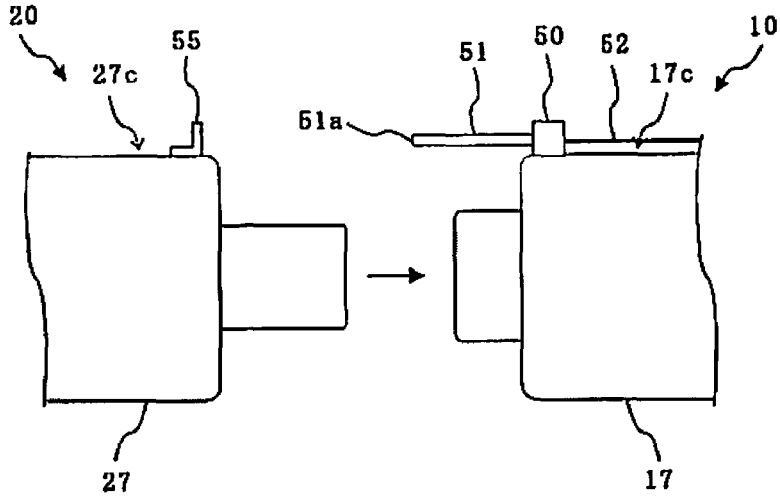
FIGS. 17A and 17B are schematic views showing the states before and after the fitting state of the coaxial connector of the invention is checked using second means.

In the meanwhile, FIG. 17A shows that the receptacle unit 10 includes a sensor 50 at a side-surface portion 17*c* of the housing 17. The sensor 50 includes a lever 51 configured to sense a contact pressure. If, for example, a leading-end portion 51*a* of the lever 51 is brought into contact with an engagement detection wall 55 provided to a side-surface portion 27*c* of the housing 27 of the plug unit 20 and senses a contact pressure, the sensor 50 generates electric signals. The electric signals generated by the sensor 50 are taken out via a wire 52, then recognized by a control circuit (not illustrated), and thereafter used for the function to instruct the transition to the subsequent process (operation) that permits RF high power to flow through the coaxial connector 1.

The electric signals generated by the sensor 50 are recognized by the control circuit. In addition, such electric signals may be used for other unillustrated purposes. For example, the electric signals may be used for generating sounds such as buzzer sounds, or for making a lighting device or the like emit light so that whether the receptacle unit 10 and the plug unit 20 are fitted together appropriately can be determined aurally or visually.

Figure 17B:
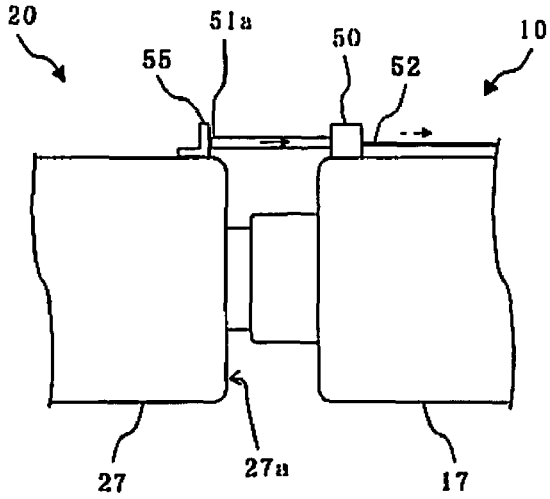

FIG. 17B shows that when the leading-end portion 51*a* of the lever 51 included in the sensor 50 is brought into contact with the engagement detection wall 55 on the side-surface portion 27*c* of the housing 27 of the plug unit 20 and senses a contact pressure, the sensor 50 generates electric signals.

Accordingly, if the receptacle unit 10 equipped with any of the sensors 50 as above is coupled to the plug unit 20, and the contact pressure sensed by the sensor 50 is recognized, the operator can easily determine that the two units 10 and 20 are fitted together appropriately, and proceed to the subsequent process (operation). In addition, if the fitting state of the two units 10 and 20 can be checked on the basis of the sounds or the light, it is easier to determine whether or not there is an abnormality of the control circuit, whether or not there is an erroneous operation in the subsequent process, or the like.

Embodiment 6

In addition, while the receptacle unit 10 and the plug unit 20 are automatically coupled (fitted) to each other with no manual work, the invention allows the checking of the coupling (fitting) state to be done easily by other means.

Figure 18A:
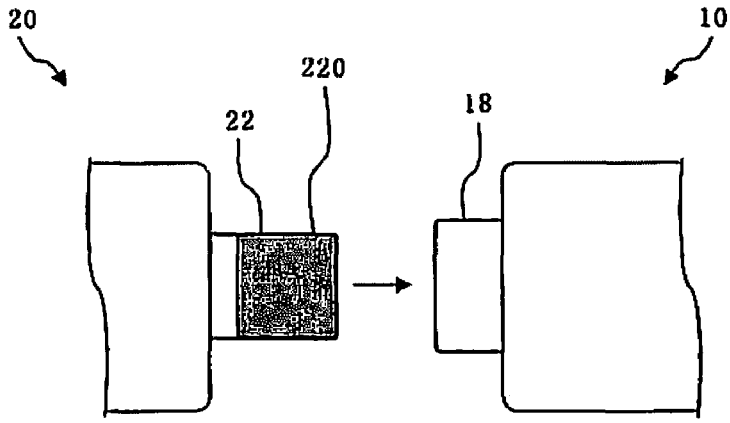
FIGS. 18A and 18B are schematic views showing the states before and after the fitting state of the coaxial connector of the invention is checked using third means.
Figure 18B:
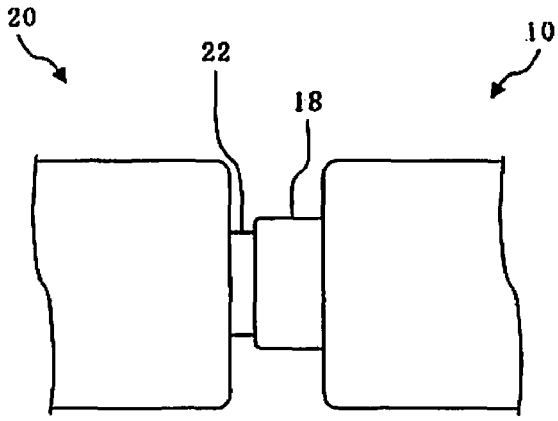

As FIGS. 18A and 18B show, this embodiment differs from each of the above-described embodiments in that a mark 220 is provided on the external surface of the outer conductor 22 in the plug unit 20.

The mark 220 is a visually recognizable character, shape, symbol, or color provided in a region that are covered by the plug receptor portion 18 of the receptacle unit 10 if the receptacle unit 10 and the plug unit 20 are fitted together appropriately. It is preferable that the mark 220 is in a different color from the color of the outer conductor 20 of the plug unit 20 for the purpose of determining easily whether the receptacle unit 10 and the plug unit 20 are fitted together appropriately.

FIG. 18A shows that the mark 220 in a distinctive color is provided in a predetermined region on the leading-end portion 22*a* side of the outer conductor 22 of the plug unit 20.

Accordingly, as FIG. 18B shows, if the outer conductor 22 of the plug unit 20 with the distinctive-color mark 220 is coupled to the plug receptor portion 18 of the receptacle unit 10, and the mark 220 cannot be visually confirmed, it is easily determined that the two units 10 and 20 are fitted together appropriately.

The above-described embodiments of the invention are each based on a case where a first connector is a receptacle unit including a female center conductor with a pitted leading end and a second connector is a plug unit including a protruding leading end. In addition, the above-described embodiments of the invention are each based on a case where a contact-section portion of the receptacle unit is capable of inclining with respect to the axial direction, but the invention will not to be limited to such embodiments.

Figure 19:
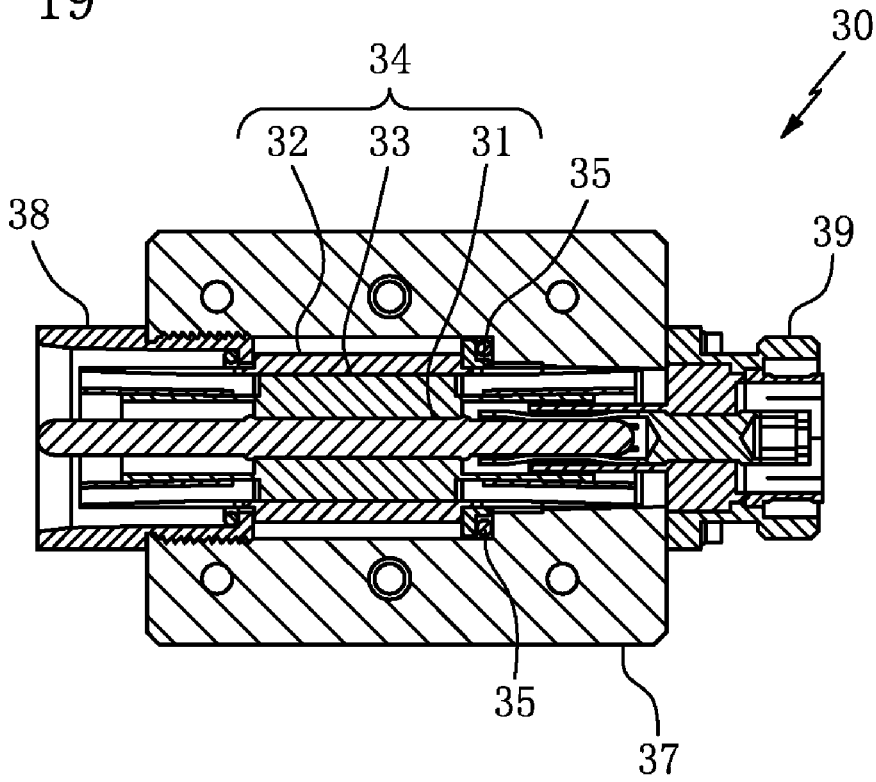
FIG. 19 is a sectional view showing a different plug unit included in the coaxial connector of the invention.

Accordingly, as FIG. 19 shows, a plug unit 30 including a male center conductor with a protruding leading end may serve as a first connector, and a contact-section portion 34 of the plug unit 30 may incline with respect to the axial direction.

Note that in FIG. 19, reference numerals 31, 32, 33, 35, 37, 38, and 39 denote a center conductor, an outer conductor, an insulator, a spacer, a housing, a receptacle receiving portion, and a coaxial-cable fixing connector portion 39, respectively.

Industrial Applicability

The invention is industrially useful in the industrial sectors that employ cable connectors for electrically connecting coaxial cables to each other. In particular, the invention is useful in a market of coaxial connectors that allow an electrical connection between coaxial cables for RF high power in an automatic manner with no manual work.

What is claimed is:

1. A coaxial connector including, as a pair of male and female connectors, a first connector and a second connector each including a contact portion that includes: a rod-shaped center conductor; and a tubular outer conductor that surrounds a circumference of the center conductor almost entirely in a lengthwise direction thereof, the contact portions of the connectors electrically connected to or disconnected from each other by being fitted to or removed from each other only by an operation of sliding the connectors along an axis of a line on which the connectors are arranged, wherein the contact portion of at least one of the connectors includes a contact-section portion in which the center conductor, the outer conductor and an insulator are formed with no gap disposed therebetween while the center conductor and the outer conductor are disposed across the insulator to be away from each other at a predetermined distance, the contact-section portion being attached to a housing included in the connector, a plurality of slots each extending in an axial direction are provided on a base-end portion side of the outer conductor in the contact-section portion, the base-end portion side being a side to be attached to the housing, the plurality of slots form base-end-side supporting pieces allowing deformation in a radial direction, and the contact portion is attached to the housing such that a gap is defined between an inner surface of the housing and surface of a leading-end side region of the contact portion opposite the base-end portion side, allowing the leading-end side region to incline with respect to the axial direction.

2. The coaxial connector according to claim 1, wherein a plurality of slots each extending in the axial direction are provided on a leading-end portion side of the outer conductor of the contact-section portion, the leading-end portion side being a side not attached to the housing, the slots form leading-end-side supporting pieces that allow deformation in the radial direction.

3. The coaxial connector according to claim 2, wherein each of the leading-end-side supporting pieces in the contact-section portion has a tapered shape with a thickness decreasing towards a leading-end side thereof.

4. The coaxial connector according to claim 1, wherein each of the base-end-side supporting pieces in the contact-section portion has a tapered shape with a thickness decreasing towards a base-end side thereof.

5. A coaxial connector according to claim 1, wherein the housing comprises an internal tubular supporting portion in which the base-end-side supporting pieces remain out of radially-pressing contact in unstressed condition of the outer conductor, and in stressed condition of the outer conductor, some of the base-end-side supporting pieces are radially-pressed by the internal surface of the housing at the tubular supporting portion and deform radially inwardly, thereby allowing the leading-end side region to incline with respect to the axial direction.

6. A coaxial connector including, as a pair of male and female connectors, a first connector and a second connector each including a contact portion that includes: a rod-shaped center conductor; and a tubular outer conductor that surrounds a circumference of the center conductor almost entirely in a lengthwise direction thereof, the contact portions of the connectors electrically connected to or disconnected from each other by being fitted to or removed from each other only by an operation of sliding the connectors along an axis of a line on which the connectors are arranged, wherein the contact portion of at least one of the connectors includes a contact-section portion in which the center conductor, the outer conductor and an insulator are formed with no gap disposed therebetween while the center conductor and the outer conductor are disposed across the insulator to be away from each other at a predetermined distance, the contact-section portion being attached to a housing included in the connector, a plurality of slots each extending in an axial direction are provided on a base-end portion side of the outer conductor in the contact-section portion, the base-end portion side being a side to be attached to the housing, the plurality of slots form base-end-side supporting pieces allowing deformation in a radial direction, and the contact-section portion is attached to the housing with a spacer disposed in between.

7. The coaxial connector accordingly to claim 6, wherein the spacer is an elastic supporting member that produces a restoring force upon deformation.

8. The coaxial connector according to claim 6, wherein the elastic supporting member is made of an insulating polymer material.

9. The coaxial connector according to claim 6, wherein the elastic supporting member is a ring-shaped body.

10. A coaxial connector including , as a pair of male and female connectors, a first connector and a second connector each including a contact portion that includes: a rod-shaped center conductor; and a tubular outer conductor that surrounds a circumference of the center conductor almost entirely in a lengthwise direction thereof, the contact portions of the connectors electrically connected to or disconnected from each other by fitted to or removed from each other only by an operation of sliding the connectors along an axis of a line which the connectors are arranged, wherein the contact portion of at least one of the connectors includes a contact-section portion in which the center conductor, the outer conductor and an insulator are formed with no gap disposed therebetween while the center conductor and the outer conductor are disposed across the insulator to be away from each other at a predetermined distance, the contact-section portion being attached to a housing included in the connector, a plurality of slots each extending in an axial direction are provided on a base-end portion side of the outer conductor in the contact-section portion, the base-end portion side being a side to be attached to the housing, the plurality of slots form base-end-side supporting pieces allowing deformation in a radial direction, the housing includes:

a pitted accommodating portion in which the contact-section portion is accommodated with a gap in between; and a supporting tubular portion that is formed contiguously to the pitted accommodating portion, has an aperture with a smaller diameter than an internal diameter of the pitted accommodating portion, and allows the base-end portion side of the outer conductor in the contact-section portion to be inserted into the supporting tubular portion, and the base-end portion side of the outer conductor of the contact-section portion is attached to the housing by a pressure-contact force exerted on the supporting tubular portion by the base-end-side supporting pieces.

11. The coaxial connector according to claim 10, wherein the housing includes a substantially tubular receptor portion including a small-diameter portion with a smaller diameter than an external diameter of the contact-section portion.

12. The coaxial connector according to claim 11, wherein the receptor portion includes a tapered surface with a thickness decreasing towards a leading-end side thereof.

13. The coaxial connector according to claim 11, wherein the receptor portion is detachably attached to the housing.

14. A coaxial connector including, as a pair of male and female connectors, a first connector and a second connector each including a contact portion that includes: a rod-shaped center conductor; and a tubular outer conductor that surrounds a circumference of the center conductor almost entirely in a lengthwise direction thereof, the contact portions of the connectors electrically connected to or disconnected from each other by being fitted to or removed from each other only by an operation of sliding the connectors along an axis of a line on which the connectors are arranged, wherein the contact portion of at least one of the connectors includes a contact-section portion in which the center conductor, the outer conductor and an insulator are formed with no gap disposed therebetween while the center conductor and the outer conductor are disposed across the insulator to be away from each other at a predetermined distance, the contact-section portion being attached to a housing included in the connector, a plurality of slots each extending in an axial direction are provided on a base-end portion side of out outer conductor in the contact-section portion, the base-end portion side being a side to be attached to the housing, the plurality of slots form base-end-side supporting pieces allowing deformation in a radial direction, and any one of the connectors has a mark provided on an external surface of the outer conductor in the contact portion, the mark allowing a determination on whether or not the one of the connectors is connected to the other connector appropriately.

15. The coaxial connector according to claim 14, wherein the mark is in a different color from a color of the outer conductor, and is provided in a region covered by the other connector when the one and the other connectors are fitted together.

16. A coaxial connector including, as a pair of male and female connectors, a first connector and a second connector each including a contact portion that includes: a rod-shaped center conductor; and a tubular outer conductor that surrounds a circumference of the center conductor almost entirely in a lengthwise direction thereof, the contact portions of the connectors electrically connected to or disconnected from each other by being fitted to or removed from each other only by an operation of sliding the connectors along an axis of a line on which the connectors are arranged, wherein the contact portion of at least one of the connectors includes a contact-section portion in which the center conductor, the outer conductor and an insulator are formed with no gap disposed therebetween while the center conductor and the outer conductor are disposed across the insulator to be away from each other at a predetermined distance, the contact-section portion being attached to a housing included in the connector, a plurality of slots each extending in an axial direction are provided on a base-end portion side of the outer conductor in the contact-section portion, the base-end portion side being a side to be attached to the housing, the plurality of slots form base-end-side supporting pieces allowing deformation in a radial direction, and any one of the connectors includes a sensor that generates electric signals which allow a determination on whether or not the one of the connectors is fitted to the other connector appropriately.

17. A coaxial connector including, as a pair of male and female connectors, a first connector and a second connector each including a contact portion that includes: a rod-shaped center conductor; and a tubular outer conductor that surrounds a circumference of the center conductor almost entirely in a lengthwise direction thereof, the contact portion of the connectors electrically connected to or disconnected from each other by being fitted to or removed from each other only by an operation of sliding the connectors along an axis of a line which the connectors are arranged, wherein the contact portion of at least one of the connectors includes a contact-section portion in which the center conductor, the outer conductor and an insulator are formed with no gap disposed therebetween while the center conductor and the outer conductor are disposed across the insulator to be away from each other at a predetermined distance, the contact-section portion being attached to a housing included in the connector, a plurality of slots each extending in an axial direction are provided on a base-end portion side of the outer conductor in the contact-section portion, the base-end portion side being a side to be attached to the housing, the plurality of slots form base-end-side supporting pieces allowing deformation in a radial direction, the first connector is a plug unit including a male center conductor with a protruding leading end, the second connector is a receptacle unit including a female center conductor with a pitted leading end, the center conductor of the second connector includes a pitted receptor portion located in a leading-end portion thereof and allowing the center conductor of the first connector to be inserted into the pitted receptor portion, and the pitted receptor portion includes a small-diameter narrowed supporting region formed with closed-end slots extending in the axial direction, and is capable of elastically coming into pressure contact with a circumference of the leading end of the center conductor of the first connector.

18. A coaxial connector including, as a pair of male and female connectors, a first connector and a second connector each including a contact portion that includes: a rod-shaped center conductor: and a tubular outer conductor that surrounds a circumference of the center conductor almost entirely in a lengthwise direction thereof, the contact portions of the connectors electrically connected to or disconnected from each other by being fitted to or removed from each other only by an operation of sliding the connectors along an axis of a line which the connectors are arranged, wherein the contact portion of at least one of the connectors includes a contact-section portion in which the center conductor, the outer conductor and an insulator are formed with no gap disposed therebetween while the center conductor and the outer conductor are disposed across the insulator to be away from each other at a predetermined distance, the contact-section portion being attached to a housing included in the connector, a plurality of slots each extending in an axial direction are provided on a base-end portion side of the outer conductor in the contact-section portion, the base-end portion side being a side to be attached to the housing, the plurality of slots form base-end-side supporting pieces allowing deformation in a radial direction, the first connector is a receptacle unit including a female center conductor with a pitted leading end, the second connector is a plug unit including a male center conductor with a protruding leading end, the center conductor of the first connector includes a pitted receptor portion located in a leading-end portion thereof and allowing the center conductor of the second connector to be inserted into the pitted receptor portion, and the pitted receptor portion includes a small-diameter narrowed supporting region formed with closed-end slots extending in the axial direction, and is capable of elastically coming into pressure contact with a circumference of the leading end of the center conductor of the second connector.

* * * * *